United States Patent [19]

Suggs

[11] 4,128,671

[45] Dec. 5, 1978

[54] INSTANT SILVERING SOLUTION

[75] Inventor: Robert Suggs, Barrington, Ill.

[73] Assignee: Reliance Electric Company, Cleveland, Ohio

[21] Appl. No.: 341,262

[22] Filed: Mar. 14, 1973

[51] Int. Cl.[2] ..... B05D 5/12; C23C 3/00

[52] U.S. Cl. ..... 427/125; 427/304; 427/429; 427/436; 427/437; 106/1.23

[58] Field of Search ..... 117/227, 130 R, 160 R, 117/35 S; 106/1, 1.23; 427/125, 429, 436, 437, 304

[56] References Cited

U.S. PATENT DOCUMENTS

| | | | |
|---|---|---|---|
| 503,358 | 8/1893 | St-Cyr | 106/1 |
| 511,810 | 1/1894 | Skinner | 106/1 |
| 1,208,507 | 12/1916 | Dalby | 106/1 |
| 2,847,332 | 8/1958 | Ramadanoff | 106/1 |
| 2,883,288 | 4/1959 | Dobbs | 117/130 R |
| 2,976,180 | 3/1961 | Brookshire | 106/1 |
| 2,976,181 | 3/1961 | Brookshire | 106/1 |
| 3,094,430 | 6/1963 | Skwierinski | 106/1 |
| 3,615,882 | 10/1971 | Nagano | 117/35 S |
| 3,776,740 | 12/1973 | Sivertz | 106/1 |

OTHER PUBLICATIONS

Frary, Transactions of American Electrochemical Soc., vol. 23, (1913), pp. 25 & 38–46.

*Primary Examiner*—Michael F. Esposito
*Attorney, Agent, or Firm*—George F. Lee

[57] ABSTRACT

This invention relates to an instant silvering solution that does not require the use of applied electrical current for plating the surfaces of copper and copper-based metal electrical connections and contacts. It is particularly designed for the application to these copper and copper-based metal surfaces for the purposes of reducing electrical resistance and the resulting heating created, caused by the build-up of copper oxide on these surfaces.

2 Claims, No Drawings

INSTANT SILVERING SOLUTION

The object of this invention is to provide a simple and convenient method for the application of a silver coating or layer to copper and copper-based metal electrical connections and contacts that will eliminate or greatly reduce the problems of over-heating, copper oxidation, electric energy waste and fire hazard that are created by the existence of exposed copper or copper-based metals in electrical connections, contacts, bus bar connections, transformer and switchgear lead connections, lugs, knife-switches, main disconnects, fuse ends, fuse clamps, fuse holders and all stationery copper contact areas. The nature of this improvement over the prior art lies in its use of an instant, one-step, silvering solution that does not require an applied electrical current for adequate plating and can be applied by simple mechanical coating action such as by means of a brush, swab, eye dropper, rag or dipping procedure.

DETAILED DESCRIPTION

The instant silvering solution comprising the invention is a clear liquid composition made up of 1 part of Silver Nitrate — analytical reagent ($AgNO_3$) by weight; 2 parts of Soduim Cyanide — analytical reagent (NaCn), by weight; and 128 parts of Distilled Water ($H_2O$) by weight. The solution is prepared in three steps. In the first step 2 parts of Sodium Cyanide are dissolved into 120 parts of Distilled Water. This may be done in any kind of container commonly used in dealing with chemical reagents. The dissolution of the Sodium Cyanide is accomplished without the use of any applied heat at a room temperature of 68°–74° F., by agitation. It is important that the proper room temperature be maintained at all stages of the process of producing the solution so as to achieve the right consistency and proper chemical bonding of the mixture and so as to prevent any possible liberation of cyanide fumes into the air.

In the second step 1 part of Silver Nitrate is dissolved into 8 parts of Distilled Water, again through agitation without the use of applied heat. The Silver Nitrate should be totally dissolved. This is necessary so as to break down the crystalline structure of the Silver Nitrate. This in turn will speed up the reaction in step 3 to a degree necessary to obtain the proper consistency for the final reaction and the proper solution strength for silver plating of copper based metals with slight fusion. An important trait of this formula is that it provides a chemical compound strong enough to plate silver on copper or copper-based metals with slight fusion and without the need of applied electric current. It plates through a chemical reaction.

The third step involves the pouring of the Silver Nitrate solution into the Sodium Cyanide solution. At this stage two reactions take place. Heat is liberated and a milky white precipitate is formed. Through agitation this precipitate of Silver Nitrate is then redissolved into the solution. When there is no further liberation of heat and when all of the milky white precipitate is gone, leaving a clear solution, the process is complete and the solution is ready for use in providing an instant Fine Silver layer or coating — with slight fusion — to the surfaces of electrical connections, contacts, bus bar connections, transformer and switchgear lead connections, lugs, knife-switches, main disconnects, fuse ends, fuse clamps, fuse holders and any other stationery copper, brass or bronze contact areas where copper oxide presents a resistence problem or for esthetic and safety reasons to exposed copper, brass or bronze surfaces. As already mentioned, a feature of the invention is that the solution may be applied by means such as a brush, swab, eye dropper, rag or dipping procedure to instantaneously form a fine layer of silver and without the need of an applied electric current.

One further point should be added for a complete understanding of this invention. In order for the reaction of plating to properly occur without any possible release of cyanide gas there should be an excess of cyanide over acid in the solution. In the disclosed coating solution, the excess is 100%, which provides an adequate margin of safety with excellent results.

What I claim is:

1. A silverplating bath in clear liquid solution form which may be applied to the surface of copper or copper-based substrates to instantaneously deposit a fine layer of silver on the surface thereof without need of applied electric current, said silverplating bath consisting of an aqueous solution in which has been combined two parts by way of sodium cyanide and 1 part of silver nitrate by weight, and the water content of the bath comprises 128 parts by weight.

2. A method of silverplating copper or copper-based substrates which does not require application of electrical current wherein the surface to be plated is contacted with a solution produced at room temperature by mixing 2 parts sodium cyanide dissolved in 120 parts water and 1 part silver nitrate dissolved in 8 parts water, and with agitation dissolving the precipitate which forms to a clear solution, the solution instantaneously depositing a fine layer of silver onto the contacted surface.

* * * * *